US007121433B2

(12) United States Patent
Nelson et al.

(10) Patent No.: US 7,121,433 B2
(45) Date of Patent: Oct. 17, 2006

(54) PORTABLE DISPENSING PUMP

(76) Inventors: John E. Nelson, 323 Rivermoor Dr., Marietta, PA (US) 17547; Hugh J. Reddington, 1071 Rose Valley Rd., Cold Brook, NY (US) 13324

( * ) Notice: Subject to any disclaimer, the term of this patent is extended or adjusted under 35 U.S.C. 154(b) by 476 days.

(21) Appl. No.: 10/743,627

(22) Filed: Dec. 22, 2003

(65) Prior Publication Data

US 2005/0135945 A1 Jun. 23, 2005

(51) Int. Cl.
*B65D 88/054* (2006.01)
*B67D 5/012* (2006.01)
*B05B 9/004* (2006.01)
*F04B 17/00* (2006.01)

(52) U.S. Cl. ..... 222/333; 222/75; 239/332; 417/411; 417/420; 417/424.1

(58) Field of Classification Search ..... 222/333, 222/377, 626, 75, 79; 239/332–334; 416/88; 417/411, 420, 424.1, 234
See application file for complete search history.

(56) References Cited

U.S. PATENT DOCUMENTS 1,007,266 A * 10/1911 Burrell ..... 415/88
2,276,404 A * 3/1942 Lundquist ..... 416/179
2,472,412 A * 6/1949 Fritz ..... 416/179
2,951,447 A * 9/1960 Casassa ..... 417/420
3,420,184 A * 1/1969 Englesberg et al. ..... 417/420
3,647,314 A * 3/1972 Laessig ..... 415/206
3,901,449 A 8/1975 Bochmann
3,915,351 A * 10/1975 Kiralfy ..... 222/385
3,993,250 A 11/1976 Shore
4,418,544 A * 12/1983 Heybutzki et al. ..... 62/50.6
4,621,770 A * 11/1986 Sayen ..... 239/304
4,735,345 A * 4/1988 Lee ..... 222/131
4,801,088 A 1/1989 Baker
5,100,058 A * 3/1992 Wei ..... 239/273

* cited by examiner

*Primary Examiner*—Kevin Shaver
*Assistant Examiner*—Melvin A. Cartagena
(74) *Attorney, Agent, or Firm*—Robert O. Wright

(57) ABSTRACT

A lightweight portable battery powered pump for moving fluids from a reservoir to a variety of end applications is disclosed. A simple and easy to manufacture centrifugal pump impeller and housing are shown.

9 Claims, 3 Drawing Sheets

PORTABLE DISPENSING PUMP

This invention relates to portable pumps and more particularly to battery powered pumps for moving a liquid such as water from a reservoir to another vessel or applications such as spraying or fire suppression.

BACKGROUND OF THE INVENTION

For a number of years now special purpose apparatus having manual or powered pumps associated therewith have been available for such things as washing cars and houses; spraying insecticides; fighting fires such as the old "Indian" pump used by forest fire fighters; to mention a few. Generally each application has required a special configuration pump made specifically to fit the end use and or the reservoir container for the fluid to be pumped. Typical of these types of devices are those shown in U.S. Pat. No. 3,993,250 to Shure and U.S. Pat. No. 4,801,088 to Baker.

OBJECTS AND SUMMARY OF INVENTION

It is therefore an object of the invention to provide a portable pump that overcomes the limitations of the prior art.

It is another object of the present invention to provide a universal portable pump that may be used with little or no modification in a number of different devices requiring pumping of fluids.

It is a further object of the present invention to provide a portable pump capable of pumping from a variety of sizes and shapes of liquid containers.

It is another object of the present invention to provide a portable pump that can safely pump a wide variety and types of fluids including many hazardous materials.

It is a still further object of the invention to provide a portable pump that can be dropped into a solution to be pumped and the pump controlled and the fluid directed to its desired application from a location displaced from the reservoir of the fluid to be pumped.

These and other n further objects are achieved in one embodiment of the invention in which a small cylindrical housing having an upper hermetically sealed compartment with a drive moor therein and a lower open ended compartment having a centrifugal pump impeller adjacent the cylinder open end magnetically operatively connected to said drive motor and a remote control spray gun electrically and fluidly connected to said motor and impeller respectively is provided for insertion in a fluid to be pumped.

BRIEF DESCRIPTION OF THE DRAWINGS

The various features, advantages ad other uses of the present invention will become more apparent by referring to the following detailed description and drawings in which.

DESCRIPTION OF A PREFERRED EMBODIMENT

Figure 1:
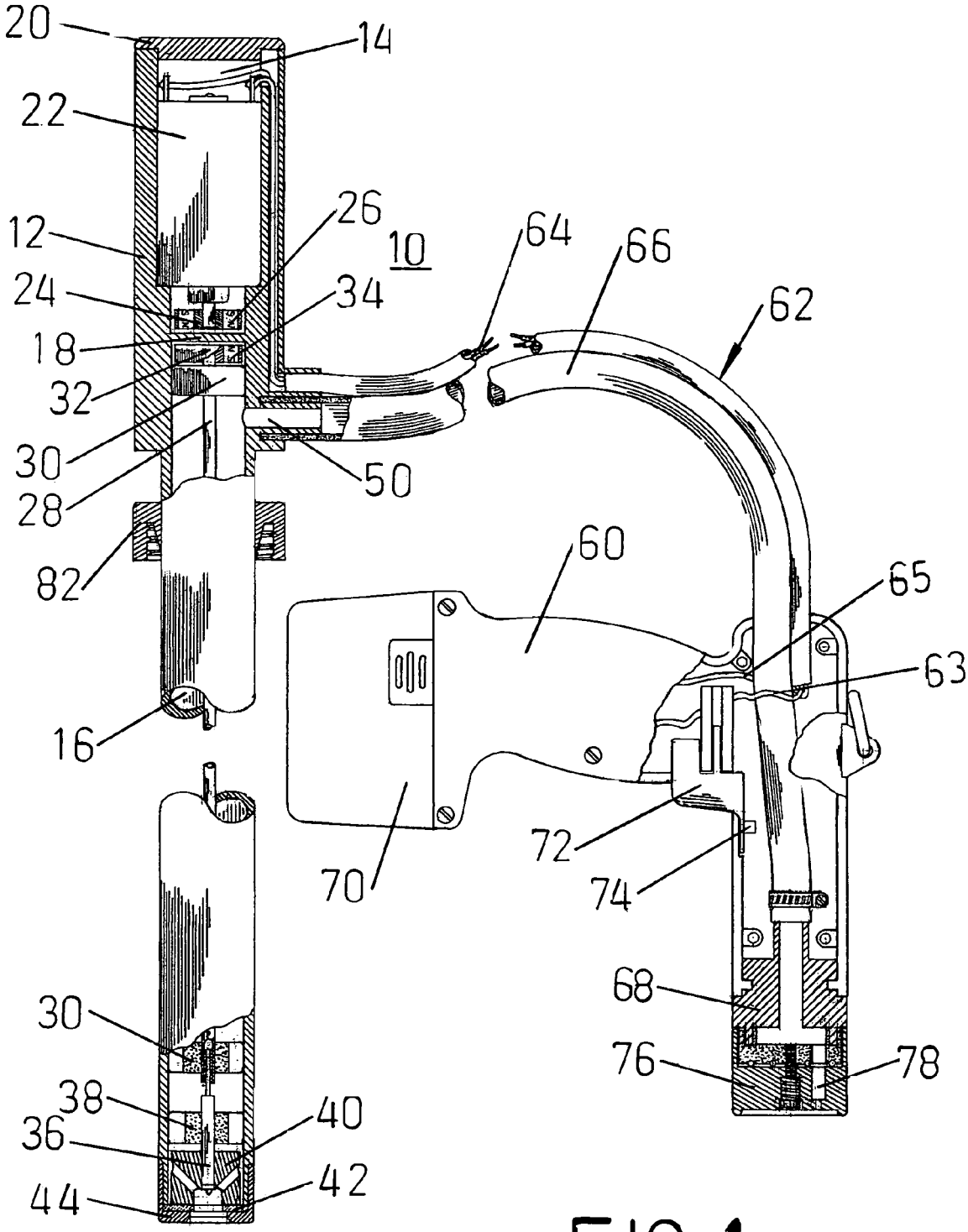
FIG. 1 is a schematic view partially in cross section of an apparatus according to the present invention.

Referring now to FIG. 1 the universal pump apparatus 10 has an elongated tube or wand 12 with an upper compartment 14 and a lower compartment 16 separated by an integrally molded partition 18. Compartment 14 is hermetically sealed by cap 20. Positioned in compartment 14 is a battery operated motor 22 and disc 24 mounted on the output shaft of motor 22. Disc 24 carries thereon at least two magnets 26.

Pump drive shaft 28 is mounted in suitable upper and lower bushings 30 within lower compartment 16 and caries at it upper end a disc 32 and magnets 34 similar to disc 24 and magnets 26. The lower end of shaft 28 is connected to impeller shaft 36 supported in bushing 38 within lower compartment 16. Impeller 40 is fixed on shaft 36 adjacent the open bottom end of tubular wand 12 lower compartment 16. A seal 42 and end cap 44 complete compartment 16.

Figure 3:
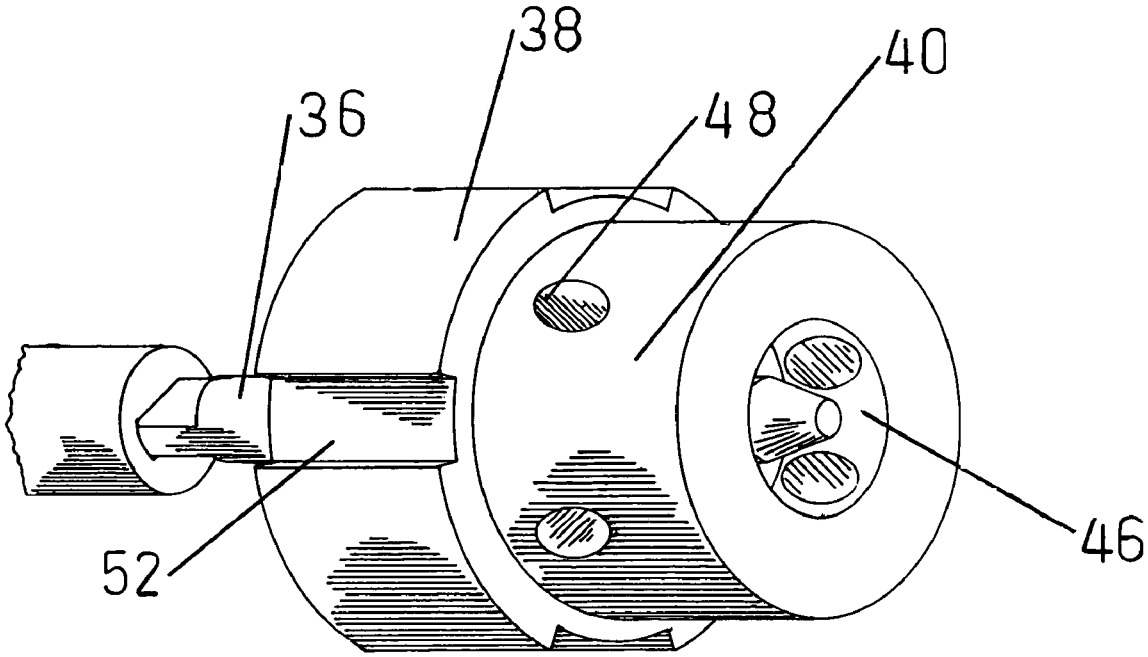
FIG. 3 is partial perspective view of the pump impeller.

Impeller 40 as may be seen in more detail in FIG. 3 consists of a small cylinder with a small counter bore 46 formed about the bottom axis thereof and four small diameter holes 48 extending downwardly from the upper periphery of the cylinder into the counter bore 46 the four holes shown are angled down at an angle of about 45 degrees. Other angles and sizes of holes as well as numbers of holes may be varied depending on the fluids to be pumped and the application of the device.

The diameter of impeller 40 is slightly less than the diameter of the lower compartment 15 leaving a small clearance for the passage of the fluid being pumped as it is drawn into the counter bore 46 and forced up and out of the holes 48 into the recess and then up through the cylindrical lower compartment 16 to an outlet port 50 formed in the wall of compartment 16 just below upper bushing 30. Bushing 38 and lower bushing 30 have by pass slots 52 to permit pumped fluid to ascend to the outlet port 50. The seal 42 has a central opening to permit the fluid to be pumped to enter the counter bore 46 but seals the outer clearance at the bottom of impeller 40 to prevent fluid from returning to the reservoir from which it is being pumped.

In one embodiment the impeller has a diameter of 0.985 inches and a height of 0.590 inches and the holes 48 have a diameter of 0.200 inches. Pump delivery volume of water per minute of 1.25 gallons to some 3 gallons have been observed depending on the nozzle used.

A pistol grip dispensing gun 60 for spraying or otherwise directing the discharge from pump impeller 40 is connected to tubular wand 12 by dual coextruded tubing member 62. A smaller tube 64 of member 62 is connected to the upper compartment 14 of wand 12 and carries wires 63 and 65 necessary to power the motor 22. Larger tube 66 is connected to output port 50 and carries the pumped fluid to the nozzle base 68 of gun 60. Tubing member 62 may be of any convenient length and tube 66 has a diameter suitable for the fluid to be pumped and the volume of fluid discharge desired.

Gun 60 has a rechargeable battery 70 fixed to the bottom of the pistol grip portion in a manner similar to other battery powered tools. We have found a NiCad 12 volt DC battery suitable for this application A trigger 72 is provided and connected though the wires 63 & 65, in tube 64 to the battery 70 and motor 22. Trigger assembly 72 may include a variable speed capability to vary the fluid discharge rate as desired. Lock pin 74 is provided to prevent undesired actuation of the pump.

Figure 2:
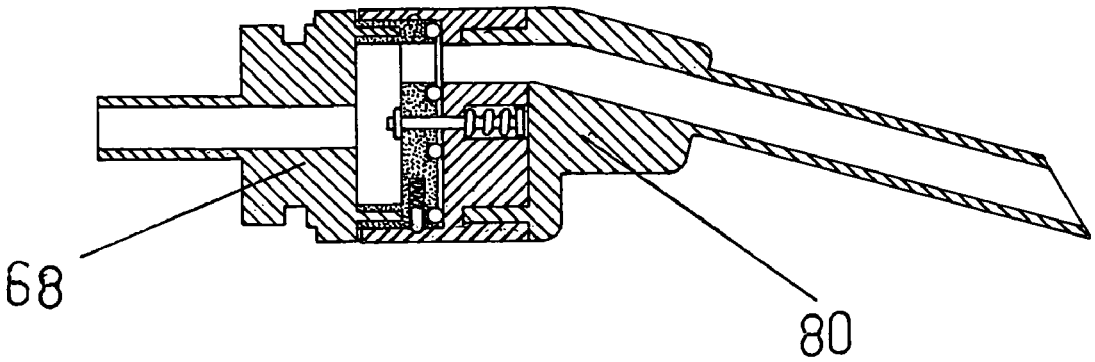
FIG. 2 is a cross sectional view of another nozzle for the pistol grip gun.

An outer nozzle shell 76 is rotatably attached to nozzle base 68 and carries in the face thereof one or more apertures that may be rotated into alignment with discharge pipe 78 for releasing the fluid in a desired pattern. An alternative nozzle 80 attached to nozzle base member 68 for full volume dispensing, is shown in FIG. 2.

A cap 82 is positioned about wand 12 just below the outlet port 50. Cap 82 forms a fluid seal about wand 12 but may be rotated about cylindrical wand 12. The cap 82 has internal threads suitable for engaging the mouth or filling orifice of various fluid reservoirs. The cap may also be adjusted vertically to position the open bottom end of wand 12 close to the bottom of a container of fluid.

It will thus be seen that with the above universal pump apparatus a wide variety of fluids may be easily pumped from a wide variety of containers. Not only can universal pump 10 be used to pump water to fight fires, water plants, wash a car etc. because of the complete separation and sealing of the electrical system from the fluid transporting system various hazardous materials may also be safely pumped. With this device gasoline may be easily and safely transferred. The wand 12 may be attached to the fluid reservoir or simply momentarily inserted into the fluid to be pumped, for transfer or use as may be the case, from a heavy and bulky container to an outboard motor, jet ski, generator, tools etc.

Figure 4:
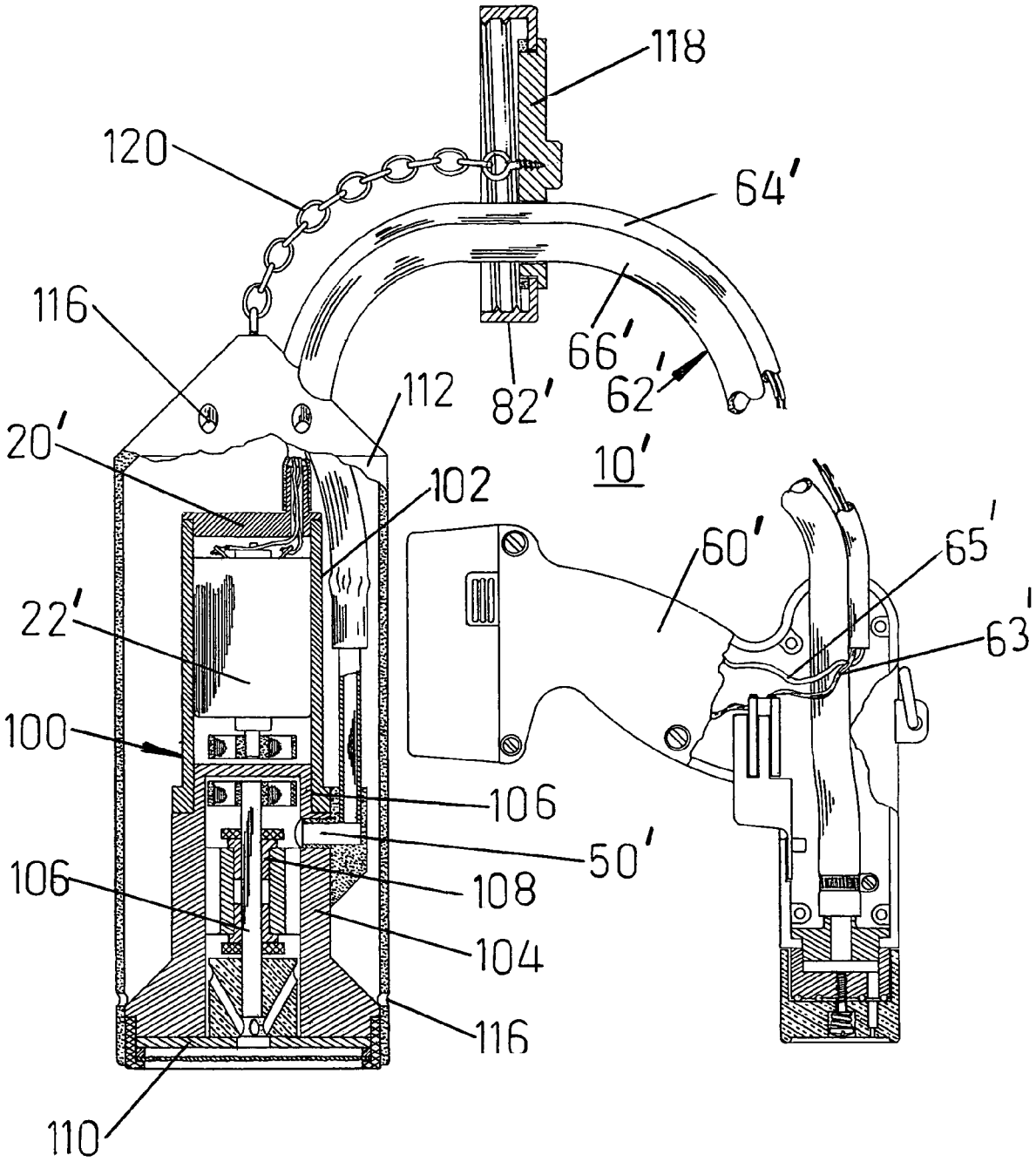
FIG. 4 is view similar to FIG. 1 of another embodiment of the invention.

Referring now to FIG. 4 there is shown another embodiment of the present invention. In the universal pump apparatus 10' elongated tube or wand 12 of FIG. 1 has been truncated to a tubular housing 100 which comprises an upper compartment 102 hermetically joined to a lower open ended housing 104 at joint 106 A drive motor 22' is fixed in upper compartment 102 and carries a similar disc and magnets as shown in FIG. 1 The lower housing 104 has a shaft 106 journaled in bushings 108. Shaft 106 carries on the upper end a disc and magnets similar to those in FIG. 1 which operatively engage with the corresponding disc and magnets on drive motor 22'. Impeller 40' is fixed on the lower end of shaft 106. Seal 110 closes the bottom of housing 104 similarly to seal 42 of FIG. 1.

The entire pump housing 100 is enclosed within a protective housing 112 which has a cone shaped top and at the bottom an end cap and screen 114 to prevent extraneous debris from entering the impeller 40'. Drain holes 116 are provided in the top and bottom of housing 112 to allow the fluid to be pumped to surround the motor 22' during pumping and to drain from the housing when the apparatus is removed from the fluid reservoir.

A dispensing gun 60' is connected to housing 100 by a dual tube 62' with small tube 64' carrying the electric wires 63' & 65' to the motor 22', and the large tube 66' being connected to a standpipe fixed to the port 50' for carrying of the fluid to be pumped to the gun Cap 20' hermetically seals the upper compartment and tube 64' so the motor can be immersed in the liquid to be pumped.

A chain 120 is attached to the top of the cone top of protective housing 112 and is also attached to the bottom of rotatable disc 118 formed in cap 82'. Dual tube 62' is fed through disc 118 so that the cap 82' may be screwed about a container orifice without twisting the dual tube member when it is desired to suspend the entire assembly in a fluid to be pumped and the cap is to be screwed onto the container.

By providing suitable lengths of chain and dual tubing the user can, with this embodiment, pump fluid from much deeper reservoir containers than with the fixed wand length of the FIG. 1 apparatus. In either case the user can project the fluid much further than with a hand pump and also deliver greater volume of fluid discharged, both of which are important in combatting fires. With the present "drop-in" invention refilling of reservoir containers can be accomplished much faster and easier.

While there are given above certain specific examples of this invention and its application in practical use, it should be understood that they are not intended to be exhaustive or to be limiting of the invention. On the contrary, these illustrations and explanations herein are given in order to acquaint others skilled in the art with this invention and the principles thereof and a suitable manner of its application in practical use, so that others skilled in the art may be enabled to modify the invention and to adapt and apply it in numerous forms each as may be best suited to the requirement of a particular use.

We claim:

1. A fluid dispensing apparatus for transferring a fluid from a reservoir of fluid through a control device to a location remote from said reservoir which comprises in combination:

an elongated tube member having an upper compartment and a lower compartment separated from each other by a fluid tight barrier therein;

a battery operated drive motor positioned in the upper compartment of said tube member;

a fluid pump means operatively mounted in the bottom of said lower compartment of said tube member;

a drive shaft operatively connected to and extending from said pump to adjacent said drive motor within said tube member;

said drive shaft being physically separated from but operatively connected to said motor;

a fluid outlet port formed in said tube member lower compartment adjacent the top thereof;

a fluid discharging member having a discharge nozzle assembly and a fluid input pipe operatively connected thereto;

a dual tubular flexible tubing member extending between said elongated tube member and said fluid discharging member;

rechargeable battery means mounted in the handle of said discharging member;

switch means positioned in said discharging member;

electric conductors positioned in one of said dual tubes of said tubing member;

said electric conductors being connected to said battery means, switch means and said drive motor; and said other tube of said dual tubing member being connected to said tube member fluid outlet port and said fluid input pipe of said discharging member;

whereby upon actuation of said switch means said motor drives said fluid pump means to transfer fluid from a reservoir thereof to said discharging member for dispensing therefrom.

2. The dispensing apparatus of claim 1 wherein:

said tube member has a small diameter cylindrical cross section to permit insertion through the fill openings of fluid containers; and said fluid pump means includes a centrifugal pump positioned in the bottom of said tube member to pump fluid up through said tube member to said fluid outlet port and said fluid discharging member.

3. The dispensing apparatus of claim 2 wherein said centrifugal pump comprises a cylindrical impeller having a diameter slightly less than the internal diameter of said elongated tube member, a small counter bore in the bottom center thereof, and a plurality of small holes angled downwardly and inwardly from the top outer periphery of said impeller to said small counter bore at the bottom center thereof; and a seal plate fixed in the open end of said elongated tube member bottom having a central hole opposite said impeller counter bore to admit fluid to be pumped and prevent pumped fluid from returning to the fluid reservoir when said impeller is rotated.

4. The dispensing apparatus of claim 2 wherein:

said drive shaft has affixed to the top thereof a small disc having a plurality of magnets mounted thereon;

a shaft extending from said drive motor and having affixed to the end thereof a corresponding small disc and plurality of magnets mounted thereon; and said discs being positioned on either side of said elongated tube member fluid tight barrier to operatively engage said drive motor to said pump means impeller.

5. The dispensing apparatus of claim 1 wherein:

said fluid pump means comprises a centrifugal pump having a cylindrical housing with an input end and an output end formed within the bottom end of said elongated tube member;

a bushing fixed in said cylindrical housing adjacent but spaced from said input end and supporting therein said drive shaft lower end;

a cylindrical impeller fixed on the lower end of said drive shaft for rotation in said bushing in operative position with said input end;

said cylindrical impeller having a diameter slightly less than said cylindrical housing, a small counter bore in the bottom center thereof, and a plurality of small holes angled downwardly and inwardly from the top outer periphery of said impeller to said small counter bore at the bottom center thereof;

said bushing having at least two slots in the periphery to permit passage there through of pumped fluid; and a fluid seal member fixed in said cylindrical housing input end having a central hole to permit entry of fluid to be pumped into said impeller counter bore and prevent return of fluid to the fluid to be pumped from said impeller outer periphery.

6. The fluid dispensing apparatus of claim 1 wherein:

said elongated tube member has been truncated to an upper motor compartment and a lower pump compartment;

said upper compartment of said truncated tube member is hermetically sealed against entry of the fluid to be dispensed;

an outer protective shell having top and bottom ends, is mounted about said truncated tube member, drive motor and pump means;

said outer shell having a fluid inlet opening in the bottom end adjacent the bottom of said truncated tube member, and drain holes in the top and bottom of said shell;

a cap member for closing of an opening in the reservoir from which fluid is to be pumped;

said cap member having an opening therein for passage through said cap of said dual tube flexible tubing member; and a flexible tether member connected between said cap member and the top of said protective shell;

whereby said truncated tube member, drive motor and pump means may be suspended in a reservoir of fluid to be pumped.

7. The fluid dispensing apparatus of claim 6 wherein:

said fluid outlet port includes a standpipe extending therefrom and connected to said other tube of said flexible tubing member; and said one of said dual tubes carrying said electric conductors is hermetically joined to said upper compartment.

8. A fluid dispensing apparatus for pumping a liquid from a reservoir to a spray gun which comprises in combination:

an elongated tube member having a top compartment and a bottom compartment separated from each other by a fluid tight barrier therein;

a battery operated drive motor positioned in the top compartment of said elongated tube member;

a pump operatively mounted in the bottom compartment of said elongated tube member;

an elongated drive shaft operatively connected to and extending from said pump to adjacent said drive motor within said elongated tube member;

said drive shaft and said drive motor each having a rotatable disc fixed thereto on either side of said barrier and a plurality of magnets mounted on said discs;

cap means closing the bottom end of said elongated tube bottom compartment to form a pump chamber and an opening in said cap to admit fluid into said pump chamber;

an outlet port formed in said elongated tube bottom compartment adjacent the top thereof;

a liquid dispensing pistol grip gun member having a discharge nozzle assembly and an input pipe operatively connected thereto;

a dual tube flexible tubing member positioned between said elongated tube member outlet port and said gun member input pipe;

rechargeable battery means mounted in the handle of said gun member;

switch means positioned in the pistol grip portion of said gun member;

electric conductors positioned in one of said dual tubes of said flexible tubing member;

said electric conductors being connected to said battery means, switch means and said drive motor;

said other tube of said flexible tubing member being connected to said elongated tube member outlet port and said input pipe of said gun member; and a fluid tight cap assembly adjustably mounted about said elongated tube member to facilitate attachment of said elongated tube member with liquid reservoirs of various depths;

whereby upon actuation of said switch means said drive motor drives said pump to transfer liquid from a container thereof to said gun member for discharge therefrom.

9. An immersable fluid pump for pumping liquid from a supply thereof which comprises in combination:

a cylindrical body portion having an hermetically sealed upper compartment and an open ended lower compartment;

a centrifugal pump formed in the open end of said lower compartment comprising a cylindrical impeller rotateably mounted in said open end having a small counter bore at the bottom axis and a plurality of small diameter holes extending downwardly from the upper periphery thereof to said counter bore;

a drive motor mounted in said hermetically sealed upper compartment physically separate from but operatively connected to said cylindrical impeller;

a liquid outlet port formed at the upper end of said lower compartment;

a control and liquid discharge assembly positioned remotely from said cylindrical body portion; and a dual tube flexible tubing member connected between said cylindrical body portion and said liquid discharge assembly having one tube connected between said said liquid outlet port and said liquid discharge assembly and the other tube connected between said upper compartment and said discharge assembly.

* * * * *